US006720294B1

(12) United States Patent
Willars et al.

(10) Patent No.: US 6,720,294 B1
(45) Date of Patent: Apr. 13, 2004

(54) LUBRICATING OIL COMPOSITIONS

(75) Inventors: Malcolm Willars, Ince Chester (GB); Peter Sant, Ince Chester (GB)

(73) Assignee: Infineum USA L.P., Linden, NJ (US)

( * ) Notice: Subject to any disclaimer, the term of this patent is extended or adjusted under 35 U.S.C. 154(b) by 0 days.

(21) Appl. No.: 09/300,191

(22) Filed: Apr. 27, 1999

(51) Int. Cl.[7] ..... C01M 129/10; C01M 129/50; C01M 141/02; C01M 135/10

(52) U.S. Cl. ..... 508/390; 508/391; 508/460; 508/518; 508/584; 508/586

(58) Field of Search ..... 508/390, 391, 508/460, 518, 584, 586

(56) References Cited

U.S. PATENT DOCUMENTS 2,197,832 A * 4/1940 Reiff ..... 508/518
2,252,662 A * 8/1941 Reiff ..... 508/518
2,951,808 A * 9/1960 Norton et al. ..... 508/518
3,052,630 A * 9/1962 Anderson ..... 508/518
3,267,034 A * 8/1966 Van der Voort ..... 508/518
3,704,315 A * 11/1972 Strang ..... 508/518
3,903,151 A 9/1975 Lowe
4,729,848 A 3/1988 Yamaguchi et al.
5,558,802 A 9/1996 Dowling
5,672,572 A * 9/1997 Arai et al. ..... 508/518
5,688,751 A * 11/1997 Cleveland et al. ..... 508/518
5,726,133 A * 3/1998 Blahey et al. ..... 508/518
5,895,777 A * 4/1999 Ueda et al. ..... 508/518

FOREIGN PATENT DOCUMENTS

EP 604218 6/1994

* cited by examiner

*Primary Examiner*—Jacqueline V. Howard

(57) ABSTRACT

A lubricating oil composition comprising, as a detergent, metal salt of a long chain hydrocarbyl-substituted organic acid, at a concentration of not more than 15 mmol/kg oil.

17 Claims, No Drawings

LUBRICATING OIL COMPOSITIONS

This invention relates to lubricating oil compositions suitable for use in the crankcase of internal combustion engines.

It is well known that the lubricating ability of lubricating oil compositions, (lubricants or simply oils) deterior rates with use in internal combustion engines. For example, in diesel (compression ignited) engines the viscosity of the oil may increase undesirably due to increasing soot levels. This increase may still occur despite the presence of ashless dispersants in the oil. A recognised measure of viscosity increase for diesel engines is the so-called Mack T8 test which forms part of the American Petroleum Institute (API) performance category CG-4. In order to attain acceptable levels of performance in tests such as the Mack T8, it is often necessary to increase the quantity of ashless dispersant present in the oil. However, this is often undesirable due to the poor seal compatibility properties of the dispersant and the increased likelihood of corrosion to bearings.

Lubricating oil compositions may also comprise neutral or overbased metal detergents as additives, or additive components. Chemically, the consist of metal salts of organic acids, such as hydrocarbyl-substituted sulphonic or aromatic carboxylic acids, or may be metal salts of hydrocarbyl-substituted phenols. Such metal salts are sometimes referred to as surfactants or as soaps. The hydrocarbyl substituents are of a sufficient length to confer oil-solubility to salts which would generally be insoluble in oils of lubricating viscosity. The metal is usually an alkaline earth metal, although other metals may also be used. Mixtures of metals may also be used.

The term "overbased" is intended to define additives which contain a metal content in excess of that required by the stoichiometry of the particular metal and the particular organic acid used. The excess metal exists in the form of particles of inorganic base, e.g. a hydroxide or carbonate, surrounded by a sheath of metal salt. The sheath serves to maintain the particles in dispersion in a liquid oleaginous vehicle. The amount of excess metal is commonly expressed as the ratio of total equivalence of excess metal to equivalence of organic acid and is typically 0.1 to 30.

The principal function of the metal detergents in lubricationg oil compositions is to neutralise acidic products within the oil, and/or to prevent the formation of deposits on the surfaces of an engine. Depending on the nature of the acid used, the detergent may have additional functions, for example, antioxidant properties. Typically, lubricating oil compositions contain metal detergents comprising either overbased detergents or mixtures of neutral and overbased detergents.

The present invention is based on the realisation that an improvement in the control of oil viscosity can be obtained, without increasing the levels of ashless dispersants, if low concentrations of surfactant in metal detergents are used in the lubricating oil composition. The metal detergents used are of long chain hydrocarbyl substituted organic acids.

Thus, a first aspect of the invention is a lubricating oil compositions comprising, as a detergent, one or more metal salts of long chain hydrocarbyl-substituted organic acids such as selected from aromatic carboxylic acids, sulfonic acids or phenol derivatives, the total concentration of such metal salts being not more than 15 mmol/kg of the composition, provided that the composition is not an SAE 5 W composition whose base stock comprises less than 5, such as less than 6 or 10, wt. % non-conventional lubricant. Preferably, the acids are selected from aromatic carboxylic acids or phenol derivatives.

The concentration of metal salt is that of the salt as such and does not include any overbaseing material (or base) in the detergent. In particular, it has been found that concentration of the metal salt as low as 8 mmol per kg oil or lower are sufficient to achieve a performance in diesel engine tests exceeding current specification requirements.

Therefore, the present invention allows the amount of ashless dispersant required to maintain the viscosity of a lubricating oil composition within acceptable limits to be reduced to economically-attractive levels, such as from 3 to 10 mass %, based on the mass of the composition. The present invention also allows the lubricating oil compositions to maintain a high level of performance in areas such as seals and bearings.

It is surprisingly found that the metal salts, in the form of salicylates when used at the above-stated concentrations, provide the lubricating oil compositions with a cleanliness performance that exceeds current specification requirements, as evidenced by performance in a range of standard US and European diesel engine tests, including:

the Caterpillar 1 K test, which forms part of the API performance category CF-4 ;

the Mercedes Benz OM364A test, which forms part of the ACEA performance categories E1-E3 96.

A second aspect of the invention is a method of making a lubricating oil composition comprising admixing a major amount of an oil of lubricating viscosity and minor amounts of metal salt as defined in the first aspect of the invention.

A third aspect of the invention is a method of lubricating a diesel engine which comprises supplying to the engine a lubricating oil composition according to the first aspect of the invention or made according to the second aspect of the invention.

A fourth aspect of the invention is a method of alleviating viscosity in a lubricating oil composition due to the presence of increasing levels of soot when the composition is lubricating a diesel engine, which comprises using, in the composition, a detergent as defined in the first aspect of the invention.

In this specification:-"Major amount" means in excess of 50 mass % of the mass of the composition.

"Minor amount" means less than 50 mass % of the mass of the composition, both in respect of the stated additive and in respect of the total mass % of all of the additives present in the composition, reckoned as active ingredient of the additive or additives.

"Comprises", or cognate words, is taken to specify the presence of stated features, integers, steps or components but does not preclude the presence or addition of one or more other features, integers, steps, components or groups thereof.

"Non-conventional lubricants (NCL's)" are basestocks that do not fall within Groups 1 and 2 according to the classification of basestocks provided by the American Petroleum Institute (API) in its Publication 1509 dated January 1993 entitled "Engine Oil Licensing and Certification System" (EOLCS) in Appendix E, 1.2.

"SAE 5 W" is a viscosity requirement as set forth in Society of Automotive Engineers (SAE) J300, namely maximum CCS viscosity of 3500 $10^{-3}$ Pa.s @−25° C., and minimum kV of 3.8 $mm^2S^{-1}$ @100° C.

Various components of the composition, essential as well is optimal and customary, may react under the conditions of formulation, storage or use; the invention also provides the product obtainable of obtained as a result of any such reaction.

The features of the invention will now be discussed in more detail as follows:

Metal Salt

Processes for the manufacture of metal detergents used in the present invention are known to those skilled in the art. The concentration of metal salt is preferable no lower than 3 or 4, or 5, more preferably between 8 and 13, mmol per kg oil. The metal detergent typically has a metal: metal salt molar ration between 1 to 10. Examples of metal detergents that may be used in accordance with the invention include calcium or magnesium alkyl salicylates, preferably $C_{14-24}$ alkyl salicylates. The total base number (TBN) of a salicylate detergent, if used, measured by ASTM D2896, is preferably 50 to 450 such as 80 to 450.

Lubricating Oil Base Stock

This may be mineral or synthetic or both.

The improved viscosity control achieved by the present invention is further enhanced if the oil of lubricating viscosity (or base stock), used in the manufacture of the composition is a mineral oil base stock containing high levels (>85%) of saturates (as measured by the ASTM method D2007).

Anti-oxidant

Reducing the metal salt content in the composition may limit the antioxidative properties of the metal detergents. It may therefore be preferable that antioxidants are added to the lubricant formulations to counter this effect. Antioxidants (or oxidation inhibitors) increase the composition's resistance to oxidation and may work by combining with and modifying peroxides to render them harmless, by decomposing peroxides, or by rendering an oxidation catalyst inert. Antioxidants that may be used in the present invention include amine anti-oxidants such as those based on aryl or alkyl-substituted amines, for example Irganox L57 (tertiary $C_{12}$ alkyl diphenylamine), or phenolic antioxidants, such as hindered phenols, for example Irganox L135 (2,6-ditertiary-butyl-4-(2-carboxy (alkyl) ethyl) phenol) (CIBA Specialty Chemicals).

Further additives, as co-additives, may be incorporated in the composition to enable it to meet particular requirements. Examples include, additional to those hereinbefore mentioned in connection with this invention, corrosion inhibitors, anti-oxidants, friction modifiers, dispersants, detergents/rust inhibitors, anti-wear agents, pour point depressants, anti-foaming agents, and viscosity modifiers.

Dispersants have been noted hereinbefore and are additives for holding solid and liquid contaminants in suspension, thereby passivating them and reducing engine deposits at the same time as reducing sludge formation. Ashless dispersants may comprise a long-chain hydrocarbon, eg polymeric, conferring oil-solubility, with a polar head, eg in the form of a functional group, for associating with particles to be dispersed. A noteworthy class of ashless dispersants is constituted by the hydrocarbon-substituted succinimides, which may be used borated or unborated.

The additives for the composition of the invention are typically blended into a base stock in amounts to enable them to provide their desired functions. Concentrates, ie concentrated dispersions or solutions of one or more additives, are known in the art and may be used in known manner to prepare the compositions of the invention.

The compositions are to lubricate mechanical engine components, particularly of an internal combustion engine, by supplying the composition thereto. A preferred engine is a diesel (compression-ignited) engine. A particular preferred composition is a heavy-duty diesel engine lubricating oil composition, ie for application in large diesel engines.

EXAMPLES

The following Examples illustrate the invention.

The lubricating oil compositions used in the example comprised the following components: an overbased calcium $C_{14-18}$ alkyl salicylate detergent, a calcium sulphonate detergent, a calcium phenate, a dispersant, an antiwear agent e.g. a zinc diaryl or dialkyl dithiophosphate, and an antioxidant. Selected components were blended to give five different fully formulated oils having the viscosity specifications corresponding to the Society of Automotive Engineers (SAE) requirements for a 15W40 multigrade oil. The oils were identical other than for their detergent type and/or concentration.

The oils were each tested in the Mack T8 engine test. Table 1 shows the rate of viscosity increase at different concentrations of metal salts (or surfactants), where specific oils are identified by the code letters A to F.

| Example | Surfactant (Soap) Concentration mmol/kg oil | Inorganic Base Concentration mmol/kg oil | VK increase @ 3.8% soot, $mm^2s^{-1}$ at 100? C. |
|---|---|---|---|
| A | 13 (salicylate) | 39 | 15.9 |
| B | 20 (13 salicylate) (7 phenate) | 54 | 29.7 |
| C | 20 (10 salicylate) (10 phenate) | 52 | 25.1 |
| D | 13 (salicylate) | 54 | 15.4 |
| E | 10 (salicylate) | 56 | 11.5 |
| F | 20 (13 salicylate) (7 sulphonate) | 54 | 15.0 |

A comparison of the results from examples A and D shows that the level of inorganic base had no effect on the overall viscosity level. It is apparent also that reducing the surfactant concentration resulted in improvements in the reduction of viscosity levels in the lubricating oil composition. The most marked effect was achieved using a salicylate surfactant concentration of 10 mmol/kg of lubricating oil composition.

Table 2 illustrates the effect of antioxidants, added in combination with the metal detergents, on the increase in viscosity in the Mack T8 engine test.

| Soap mmol/kg oil | Inorganic Base mmol/kg oil | Antioxidant And mass % | VK increase @ 3.8% soot, $mm^2s^{-s}$ at 100? C. |
|---|---|---|---|
| 13 Salicylate | 54 | None | 15.02 |
| 13 Salicylate | 54 | 0.5% Phenolic | 10.63 |
| 13 Salicylate | 54 | 0.5% Aminic | 11.86 |

As shown, the addition on a phenolic or aminic antioxident results in a reduction in the rate of viscosity increase when compared with metal detergents lacking an antioxident.

Table 3 illustrates the performance of a lubricating oil composition comprising a metal detergent consisting of 10 mmol salicylate surfactant per kg oil and 61 mmol inorganic base per kg oil, in a range of standard US and European engine cleanliness tests.

TABLE 3

A. Maintained European diesel engine cleanliness performance (CE-L-42-A-92).

| | Test Result | Recognised Permitted Levels MB228:1/ACEA E2 |
|---|---|---|
| Average bore polish | 3.3% | =8% |
| Average cylinder wear | 4.1 im | =7 im |
| Piston cleanliness | 31.9 merit | =31 merit |
| Average Engine Sludge | 9.7 | >9 |
| Oil Consumption (total), kg (start of test oil | 17.61 | >18 kg |

TABLE 3-continued

| Consumption, g/hr 0.67) | | |
|---|---|---|
| B. US diesel cleanliness performance. Caterpillar 1N. | | |
| | Test Result | Recognised Permitted Level 1st time pass CG-4 |
| Top Groove Fill (TGF) | 8% | 20% max |
| Weigthed Demerits CAT-N1 (WDN) | 254.6 demerits | 286.2 demerits max |
| Top Land Heavy Carbon (TLHC) | 0.0 | 3% max |
| Average Oil Consumption | 0.21 | 0.5 max (g/kw/hr) |
| C. Caterpillar 1K. | | |
| | Test Result | Recognised Permitted Level 1st time pass CF-4 |
| Weighted Demerits CAT-K1 | 299 demerits | 322 demerits max |
| Top Groove Fill (TGF) | 8.5% | 24% max |
| Top Land Heavy Carbon (THLC) | 0.0 | 4.0% max |
| Average Oil Consumption | 0.14 | 0.274 max (g/kw/hr) |

The results show that lubricating oil compositions comprising metal detergents of the present invention are able to achieve acceptable levels of performance in each of the cleanliness tests.

What is claimed is:

1. A heavy duty diesel lubricating oil composition comprising, as a detergent, one or more overbased metal salts of long chain hydrocarbyl-substituted organic acids selected from the group consisting of aromatic carboxylic acids, sulfonic acids and phenol derivatives, the total concentration of said metal salts being not more than 15 mmol/kg of the composition, provided that the composition is not an SAE 5 W composition whose base stock comprises less than 10 wt. % non-conventional lubricant.

2. A lubricating oil composition comprising, as a detergent, one or more overbased metal salts of long chain hydrocarbyl-substituted acids selected from the group consisting of aromatic carboxylic acids or phenol derivatives, the total concentration of said metal salts being not more than 15 mmol/kg of the composition, provided that the composition is not an SAE 5 W composition whose base stock comprises less than 10 wt. % non-conventional lubricant.

3. The composition as claimed in claim 1 wherein the concentration is between 5 and 15 mmol/kg of the composition.

4. The composition as claimed in claim 3 wherein the metal salt is a calcium alkyl salicylate.

5. The composition as claimed in claim 1 wherein the carboxylic acid is a $C_{14-24}$ alkyl salicylic acid.

6. The composition as claimed in claim 1 further comprising an anti-oxidant selected from the group consisting of an aminic anti-oxidant and a phenolic anti-oxidant.

7. The composition as claimed in claim 6 wherein the anti-oxidant is a tertiary $C_{4-12}$ alkyl diphenylamine.

8. The composition as claimed in claim 6 wherein the anti-oxidant is a 2,6-ditertiary-butyl-4-(2-carboxy(alkyl) ethyl) phenol.

9. The composition as claimed in claim 1 wherein the detergent has a metal:metal salt ratio of between 1 to 10.

10. The composition as claimed in claim 1 comprising a base stock in the form of a mineral oil base stock containing greater than 85% of saturates, as measured by ASTM method D2007.

11. The composition as claimed in claim 1 further comprising a dispersant at a concentration of 3 to 10 mass % based on the mass of the composition.

12. The composition as claimed in claim 1 free of a magnesium salt detergent.

13. A method of lubricating a diesel engine which comprises supplying to the engine a lubricating oil composition as claimed in claim 1.

14. A method of alleviating viscosity increase in a lubricating oil composition due to the presence of increasing levels of soot when the composition is lubricating a diesel engine, which comprises lubricating the diesel engine with a lubricating oil composition as claimed in claim 1.

15. A method of lubricating a diesel engine which comprises supplying to the engine a lubricating oil composition as claimed in claim 2.

16. A lubricating oil composition as claimed in claim 1 wherein the concentration is between 8 and 13 mmol/kg of the composition.

17. A lubricating oil composition as claimed in claim 2 wherein the concentration is between 8 and 13 mmol/kg of the composition.

* * * * *